United States Patent [19]

Herold et al.

[11] 4,155,306

[45] May 22, 1979

[54] OUT-OF-LINE IGNITER

[75] Inventors: Stanley J. Herold, Switz City; Donald E. LaGrange; Steven R. Norris, both of Washington; David K. Sanders, Bloomington; John E. Wildridge, Washington, all of Ind.

[73] Assignee: The United States of America as represented by the Secretary of the Navy, Washington, D.C.

[21] Appl. No.: 810,695

[22] Filed: Jun. 28, 1977

[51] Int. Cl.[2] ..... F42C 15/34; F42B 4/28

[52] U.S. Cl. ..... 102/35; 102/254; 102/258; 102/261; 102/274

[58] Field of Search ..... 102/35, 254, 255, 256, 102/258, 261, 274; 89/1.5 D

[56] References Cited

U.S. PATENT DOCUMENTS

| | | | |
|---|---|---|---|
| 3,313,236 | 4/1967 | Lohmann | 102/256 |
| 3,712,232 | 1/1973 | Abel et al. | 102/279 |
| 3,736,877 | 6/1973 | Roberts et al. | 102/35 |
| 4,029,014 | 6/1977 | Cunningham | 102/35 |
| 4,085,679 | 4/1978 | Webb et al. | 102/258 |

*Primary Examiner*—Verlin R. Pendegrass
*Attorney, Agent, or Firm*—R. S. Sciascia; Paul S. Collignon

[57] ABSTRACT

An out-of-line igniter assembly having a primer located out-of-line of an ignition train and movable to an in-line position for ignition of a main pyrotechnic charge. A housing has a raceway connected with a gas expansion chamber and a pellet chamber, and a slider having a primer and a striker assembly is movable in the raceway. Premature detonation of the primer causes the primer to fire into the gas expansion chamber but, in normal operation, the slider is moved so that the primer is fired into the pellet chamber. Movement of the slider causes the striker assembly to actuate when the slider is in an in-line position with the pellet chamber.

5 Claims, 5 Drawing Figures

OUT-OF-LINE IGNITER

BACKGROUND OF THE INVENTION

The present invention relates to an ignition system for an ordnance item and is particularly useful for igniting an aircraft parachute flare which is deployed from an aircraft.

An aircraft parachute flare is normally provided with three sections or components, namely a parachute, a section containing a pyrotechnic composition and an ignition system.

As an aircraft parachute flare is an expendable item, possibly the most important features on these flares are the safety features which attempt to prevent accidental or premature ignition of the pyrotechnic composition. As the illuminating materials which are used in present day flares provide extreme heat upon burning, any accidental igntion of these flares could result in a catastrophic disaster, particularly if the flares are in storage aboard a ship. In order to provide some measure of safety, most present day flares are provided with a safety pin which is kept in position until the flare is mounted in a launching rack on an aircraft. In the event the aircraft returns with flares, the safety pins are reinserted.

In the past, however, primers have been accidentally ignited without actuation of a firing pin. Such detonation can occur, for example, when a device accidentally drops off an aircraft upon a hard landing and, when aboard an aircraft carrier, a dangerous condition is created. Detonation of the primer is normally followed by ignition of an ignition composition which, in turn, ignites the main pyrotechnic charge.

One arrangement for preventing accidental igntion of a pyrotechnic charge such as that occasioned by a fall or drop, is to have one of the elements of a pyrotechnic train out-of-line with the other elements. This out-of-line arrangement prevents a chain reaction of the pyrotechnics element until a sequence of events occur during normal deployment of the ordnance item.

One such out-of-line device is shown and described in U.S. Pat. No. 3,763,785, entitled, "Mal-Assembly Feature For Explosive Train Fuzes", which issued Oct. 9, 1973, to George S. Briggs and Marvin W. Keith, Jr. In this patented device, a portion of the explosive train is contained in an arming rotor and held in an out-of-line safe position until the arming rotor is rotated to an in-line position.

Another out-of-line device is shown and described in U.S. Pat. No. 3,744,425, entitled "Explosive-Disseminator Package", which issued July 10, 1973, to Richard C. Grimm. In this device, chaff is dispensed from a package by explosive action. Detonation of a primer ignites a delay composition, however the delay composition must be slidably moved before a detonator and detonating cord are actuated.

SUMMARY OF THE INVENTION

The present invention relates to an igniter assembly which is designed and constructed to be mated with an aircraft parachute flare and to ignite a pyrotechnic composition upon deployment of a parachute. The ignition sequence consists of detonation of a primer by a striker assembly, ignition of igniter pellets by the primer and finally ignition of a flare composition by the burning of the igniter pellets. Prior to parachute deployment, however, the primer is positioned out-of-line from the igniter pellets and accidental or inadvertent detonation of the primer causes the primer to fire into an empty compartment and the igniter pellets are not ignited.

Upon deployment of a parachute, a lanyard, which is attached between a movable striker assembly and a parachute, moves the primer to an in-line-position with igniter pellets while simultaneously cocking and releasing the striker assembly. The striker assembly detonates the primer after it has become aligned with the ignition pellets.

Two locking arrangements are provided to further insure safety of operation and proper functioning of the striker mechanism. One locking arrangement prevents movement of the primer and striker assembly until an initial pull on the lanyard causes the lock to release. A second locking device is provided on a slider holding the primer and striker mechanism and locks the slider after it has been moved to an in-line position, that is, a position where the primer will fire into and ignite the ignition pellets.

It is therefore a general object of the present invention to provide an out-of-line ignition system for an ordnance item thereby preventing inadvertent ignition of the ordnance item during transportation or storage.

Another object of the present invention is to provide safety features to an igniter assembly which must function in a prescribed sequence of operation in order to effect ignition of a pyrotechnic store.

Other objects and advantages of the present invention will be readily appreciated as the same becomes better understood by reference to the following detailed description when considered in connection with the accompanying drawings.

DESCRIPTION OF THE PREFERRED EMBODIMENT

Figure 1:
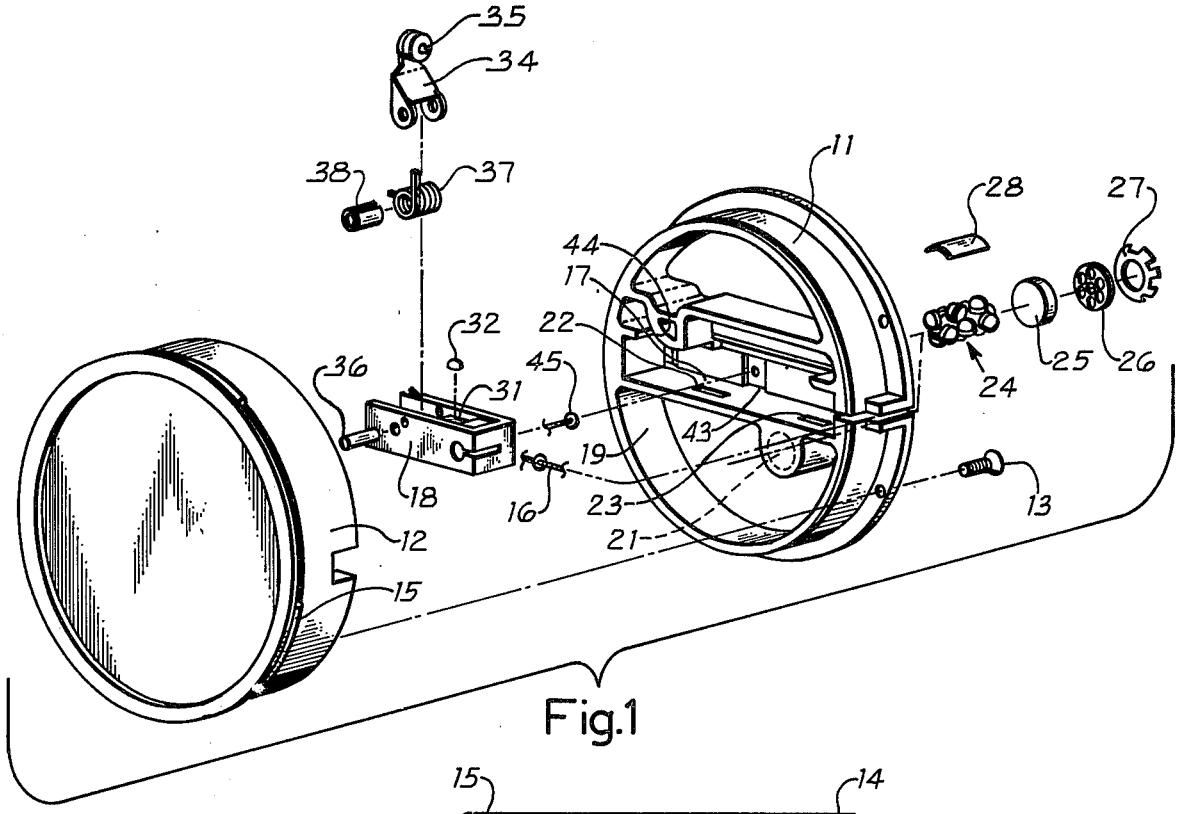
FIG. 1 is an exploded view of a preferred embodiment of the present invention.

Referring now to the drawings, there is shown an igniter assembly designed to be used with an aircraft parachute flare. A typical aircraft parachute flare is shown in U.S. Pat. No. 3,712,232, entitled "Variable Delay Fuse For Aircraft Parachute Flare", which issued Jan. 23, 1973, to Carroll Abel et al. The device is comprised of a parachute section, a flare composition section and a fuse or ignition section, and initiation of the fuse is started by the force exerted by the opening of the parachute. The present invention relates to an improved ignition device and could be used to replace the variable delay fuse shown in U.S. Pat. No. 3,712,232.

Figure 2:
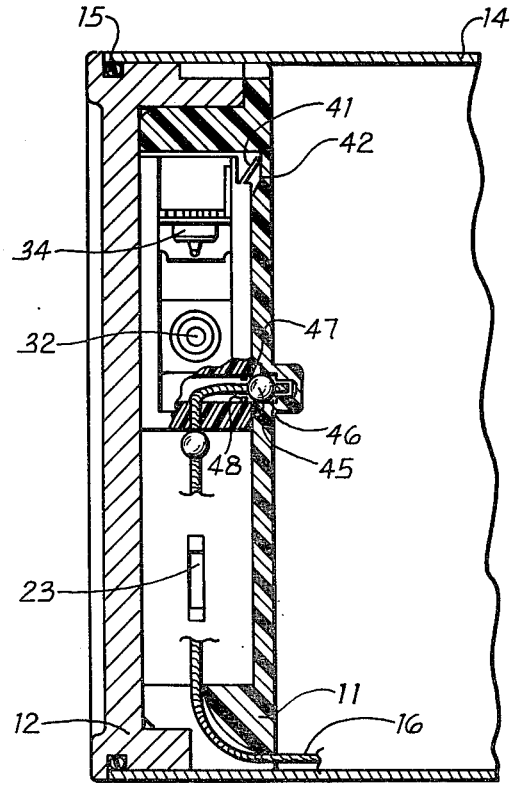
FIG. 2 is a longitudinal sectional view of the preferred embodiment shown in FIG. 1 of the drawings.

A housing 11, which might be constructed of plastic or light weight metal, has a closure cap 12 attached thereto by screws 13, and, as best shown in FIG. 2 of the drawings, a container 14 can be mated about housing 11 and cap 12, with an O-ring 15 being provided to seal the container. Container 14 would carry a parachute and a pyrotechnic composition, as shown in U.S.

Pat. No. 3,712,232, and a lanyard 16 is provided to initiate ignition as hereinafter described.

Housing 11 is provided with various compartments, with one compartment being a raceway 17 in which a slider 18 can move. A gas expansion chamber 19 and a pellet chamber 21 are also provided in housing 11 and a first slot 22 forms a passageway between raceway 17 and gas expansion chamber 19, and a second slot 23 forms a passageway between raceway 17 and pellet chamber 21. Pellet chamber 21 is opened at one end, that is, the end which will be adjacent a pyrotechnic composition, and a quantity of igniter pellets 24 are provided in chamber 21 and retained by cushion 25, plate 26 and retaining ring 27. Cushion 25 will readily burn and plate 26 is provided with a plurality of holes through which heat and flames can pass to ignite the adjacent pyrotechnic composition. A small piece of adhesive-backed aluminum foil 28 is provided inside pellet chamber 21 in order to close slot 23 and provide a moisture bearer.

Slider 18 is provided with a bore 31 that holds a primer 32 and a small hole 33 is provided in the bottom of slider 18 through which heat and flame can travel when primer 32 is detonated. A striker 34 having a firing pin 35 thereon is pivotally mounted about shaft 36 which is attached to slider 18 and a spring 37 is positioned around spacer 38 and shaft 36 to provide the force necessary for striker 34 to detonate primer 32. Slider 18 is provided with a stop arm 41 on its sliding surface, and stop arm 41 extends rearwardly and angularly below the sliding surface of slider 18. As best shown in FIG. 2 of the drawings, housing 11 is provided with a relief slot 42 and stop arm 41 extends into relief slot 42 so that stop arm 41 will retain its resiliency and not take a permanent set during storage. A stop slot 43 is provided in housing 11 and stop arm 41 is engageable therein to lock slider 18 in raceway 17 after movement of slider 18. A cam surface is provided in housing 11 to cock and trigger striker 34.

OPERATION

Figure 3:
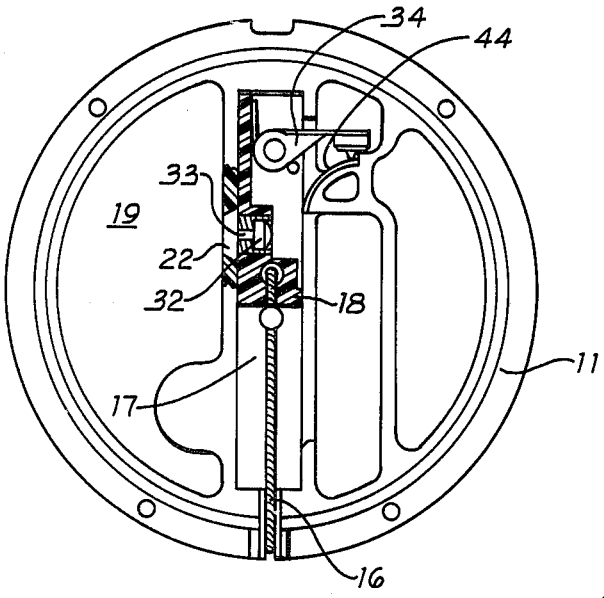
FIG. 3 is a plan view, with cap removed, of the preferred embodiment and showing a slider, primer and striker assembly in a stored or safe position.

FIG. 3 of the drawings shows the present invention in a stored and safe position. Striker 34 is partially cocked and in engagement with cam surface 44 and cam surface 44 acts as an impediment to keep slider 18 in position. Additionally, ball 45 on lanyard 16 is partially engaged in recess 46 in housing 11 and partially engaged in bore 47 in slider 18. A thin-walled web 48, which is preferably molded integral with slider 18, keeps ball 45 on lanyard 16 in position and thus ball 45 locks slider 18 with housing 11. In this locked position, stop arm 41 extends into relief slot 42, and the small hole 33 in slider 18 is adjacent slot 22. In this locked position, any inadvertent detonation of primer 32 will direct the heat and flame from primer 32 to pass through hole 33 and slot 22 into gas expansion chamber 19, and igniter pellets 24 will not be ignited.

Figure 4:
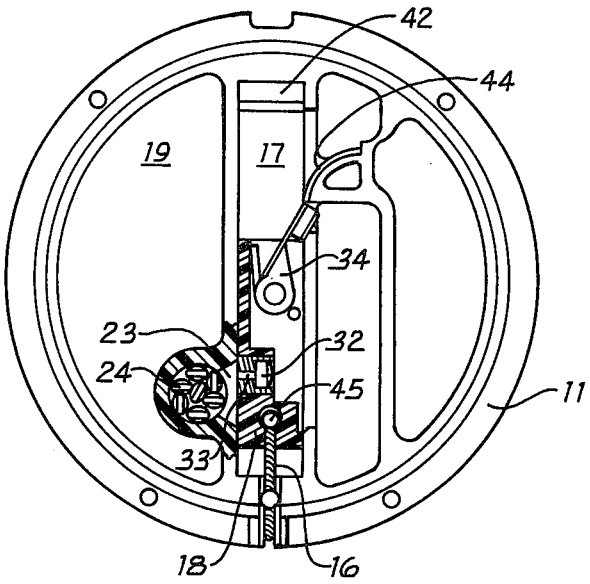
FIG. 4 is a plan view, with cap removed, showing a striker assembly in an actuating position.
Figure 5:
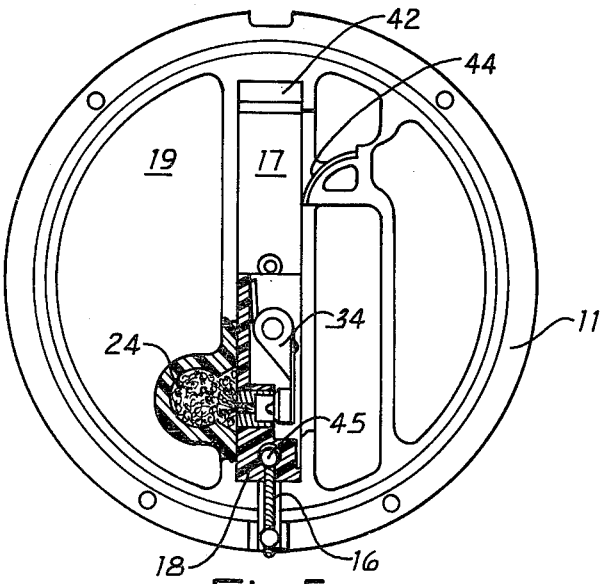
FIG. 5 is a plan view, with cap removed, showing a primer being detonated by a striker assembly.

Upon deployment of a parachute, the initial pull on lanyard 16 will cause ball 45 to shear web 48 and slider 18 will be unlocked from housing 11. Continued pull of lanyard 16 will move slider 18 forward, and stop arm 41 will leave relief slot 42 and be bent as it engages the bottom of raceway 17. As slider 18 moves forward, cam surface 44 will fully cock striker 34. As best shown in FIG. 4 of the drawings, when hole 33 in slider 18 becomes aligned with slot 23 in housing 11, the firing position will be reached and stop arm 41 on slider 18 will snap into stop slot 43 and lock slider 18 in the firing position. At this time, striker 34 will have cleared cam surface 44 and spring 37 will rotate striker 34 about shaft 36, and firing pin 35 will detonate primer 32. As best shown in FIG. 5 of the drawings, the heat and flames caused by the detonation of primer 32 will pass through hole 33 and slot 23 to ignite pellets 24. The heat and flame from the burning of pellets 24 will pass through holes in plate 26 and ignite the main pyrotechnic charge.

It can thus be seen that the present invention provides improved safety features to an ignition system by keeping pyrotechnic compositions out-of-line with one another until the ignition system is actuated by a series of events. Inadvertent detonation of a primer in the system due to a shock will cause the primer to fire into a gas expansion chamber, however, the other elements of the ignition train will not be ignited.

Obviously, many modifications and variations of the present invention are possible in light of the above teachings. It is therefore to be understood that the invention may be practiced otherwise than as specifically described.

We claim:

1. In an aircraft parachute flare having a flare composition and a parachute, an igniter assembly comprising, a housing, an ignition composition in said housing for igniting said flare composition, a slider in said housing having a firing pin attached thereto, a firing pin spring attached to said slider for actuating said firing pin, a primer in said slider positioned to be detonated by said firing pin, said slider being movable in said housing to position said primer in an out-of-line position relative to said ignition composition and an in-line position relative to said ignition composition, a lanyard connected between said parachute and said slider for moving said slider in said housing, and cam means in said housing for cocking said firing pin and said firing pin spring when said slider is moved by said lanyard and for triggering said firing pin to detonate said primer when said primer is aligned with said ignition composition.

2. In an aircraft parachute flare having a flare composition and a parachute, an igniter assembly as set forth in claim 1 having means on said lanyard for locking said slider with said housing when said primer is positioned in an out-of-line position relative to said ignition composition.

3. In an aircraft parachute flare having a flare composition and a parachute, an igniter assembly as set forth in claim 1 having means for locking said slider with said housing when said primer is in an in-line position relative to said pyrotechnic ignition composition.

4. In an aircraft parachute flare having a flare composition and a parachute, an igniter assembly comprising, a housing having a raceway, a gas expansion chamber and a pellet chamber and having a first passageway connecting said gas expansion chamber and said raceway and a second passageway connecting said pellet chamber and said raceway, a quantity of ignition pellets in said pellet chamber, a slider slidably positioned in said raceway and having a pivotally mounted firing pin attached thereto, a firing pin spring attached to said slider for actuating said firing pin, a primer in said slider positioned to be detonated by said firing pin, first means for locking said slider to said housing with said primer being aligned with said first passageway whereby inadvertent detonation of said primer causes said primer to fire into said gas expansion chamber, second means for locking said slider to said housing with said primer being aligned with said second passageway whereby detonation of said primer causes said primer to fire into said pellet chamber, a lanyard connected with said parachute and said slider for moving said slider in said raceway upon parachute deployment, and cam means in said raceway for cocking said firing pin and said firing pin spring when said slider is moved by said lanyard and for triggering said firing pin when said slider is moved to a position where said primer is aligned with said second passageway whereby said firing pin spring rotates said firing pin to detonate said primer.

5. In an aircraft parachute flare having a flare composition and a parachute, an igniter assembly as set forth in claim 4 wherein said second means for locking said slider to said housing comprises a stop arm on said slider engageable with a stop slot in said raceway.

* * * * *